US006314645B1

(12) United States Patent
Wahl

(10) Patent No.: US 6,314,645 B1
(45) Date of Patent: Nov. 13, 2001

(54) CIGARETTE PERFORATOR

(76) Inventor: Joseph N. Wahl, 17200 Westgrove, Apt. 1226, Addison, TX (US) 75001-7129

( * ) Notice: Subject to any disclaimer, the term of this patent is extended or adjusted under 35 U.S.C. 154(b) by 0 days.

(21) Appl. No.: 09/505,490

(22) Filed: Feb. 16, 2000

(51) Int. Cl.[7] ..... A24F 13/24

(52) U.S. Cl. ..... 30/113; 30/366; 30/358; 131/253

(58) Field of Search ..... 30/109, 111, 113, 30/358, 366; 131/233, 252, 253

(56) References Cited

U.S. PATENT DOCUMENTS

| | | | | |
|---|---|---|---|---|
| 443,942 | * | 12/1890 | Heinrich . | |
| 474,793 | | 5/1892 | Castro . | |
| 738,540 | | 9/1903 | Hopkins . | |
| 1,368,443 | * | 2/1921 | Lackner . | |
| 2,333,049 | | 10/1943 | Shapiro . | |
| 3,349,779 | | 10/1967 | Leonard et al. . | |
| 4,054,146 | | 10/1977 | Ortiz, Jr. | 131/170 |
| 4,120,309 | | 10/1978 | Brantl et al. | 131/170 |
| 4,231,378 | | 11/1980 | Stevens | 131/253 |
| 5,678,574 | | 10/1997 | Huang et al. | 131/255 |
| 5,873,166 | * | 2/1999 | Page . | |

* cited by examiner

*Primary Examiner*—Hwei-Siu Payer
(74) *Attorney, Agent, or Firm*—Howison, Chauza, Thoma, Handley & Arnott, L.L.P.

(57) ABSTRACT

An apparatus for perforating a cigarette comprises a torus-shaped body having an aperture therethrough and a pair of spring-loaded reciprocating pins disposed within respective bores oriented in linearly opposing relationship along a common diameter of the aperture. The reciprocating pins are pointed at their inward ends and are held in retracted positions with their respective bores until an external pressure, applied by the user's fingers, for example, is exerted on the distal ends of the reciprocating pins, causing them to move inward toward each other and to pierce the outer covering of a cigarette inserted within the aperture. The reciprocating pins may be operated together to simultaneously perforate opposite sides of the cigarette which is inserted within the aperture of the cigarette perforator.

13 Claims, 3 Drawing Sheets

CIGARETTE PERFORATOR

TECHNICAL FIELD OF THE INVENTION

The invention of the present disclosure pertains generally to tobacco use devices and more particularly to an apparatus for perforating cigarettes.

BACKGROUND OF THE INVENTION

Various devices are available for perforating the outer covering of a cigarette or otherwise modifying the cigarette in some way to reduce the toxicity of the tobacco smoke by mixing fresh air with the tobacco smoke thereby diluting the smoke. Heretofore, such devices are characterized by complexity because of elaborate construction or providing the capability of perforating a plurality of cigarettes at one time. Further, such devices are more costly to manufacture and in some cases too bulky to conveniently carry in a pocket or a small purse. Other devices do not perforate the outer covering of the cigarette and therefore do not provide the desired toxicity reduction by admitting fresh air to dilute the smoke produced by the combustion of tobacco. What is needed is a pocket sized cigarette perforating device that is very simple to manufacture and to operate and which enables efficient perforation of a cigarette to a user's individual preferences.

SUMMARY OF THE INVENTION

The present invention disclosed and claimed herein, an apparatus for perforating a cigarette, comprises a body having a torus shaped portion, said torus shaped portion having an inside diameter forming an aperture and an outside diameter, and a handle portion contiguous with said torus shaped portion and extending along a radius of said torus shaped portion beyond said outside diameter, wherein said aperture is sized to allow passage of said cigarette therethrough; first and second bores disposed through opposite sides of said torus shaped portion along an acting diameter of said torus shaped portion and oriented approximately perpendicular to said radius; and first and second spring-loaded, reciprocating pins formed to a point at each inward-directed end and set in linearly opposing relationship along said acting diameter of said torus shaped portion respectively in said first and second bores.

In one aspect of the present disclosure, each said first and second pin is biased to a retracted position under spring loading within each said respective first and second bore such that said respective pointed end of each said first and second pin is disposed within said retracted position within said respective body portion of said torus shaped portion and the distal end of each said first and second pin extends outward from said first and second respective bores beyond said outside diameter of said body of said torus shaped portion by a first pre-determined distance.

In another aspect, said first and second pins are operable to move inward within said first and second respective bores from said retracted position and enter said aperture upon applying radially inward pressure upon said first or second pins against said spring loading and along the longitudinal axis of each said first and second bore such that said respective pointed end of said first or second pin is caused to move longitudinally inward toward each other into said aperture by a second predetermined distance and pierce the outer covering of a cigarette inserted into said aperture.

In another aspect of the present disclosure, the body of said apparatus is sized to be held within a person's hand and configured to permit exerting pressure upon said distal ends of said second and first pins with said person's thumb and at least one finger respectively of said hand.

In yet another aspect of the present disclosure a helical spring is axially disposed over the pointed end of each said first and second pins between an inward end of said respective bore and an inward side of a shoulder portion of the respective pin such that the helical spring provides spring loading for retracting the first or second pin within the respective first or second bore. In another aspect the spring loading is provided by a flat, longitudinal spring supporting the respective pin at one end within the respective bore and the opposite end of the spring is fixed within the body of the cigarette perforator such that the respective pin is supported in cantilever fashion by the flat, longitudinal spring.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1A:
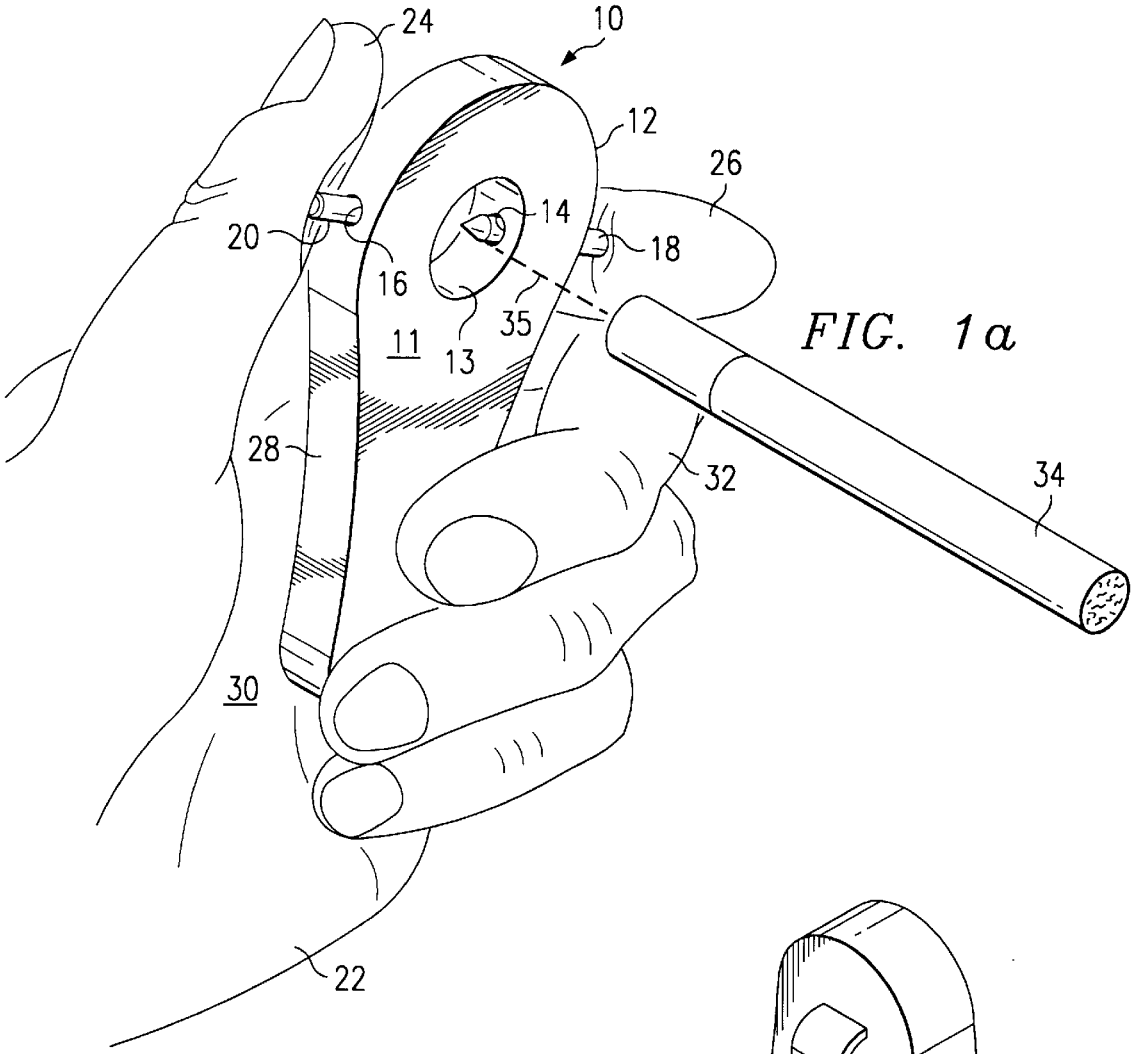
FIG. 1*a* illustrates an embodiment of the cigarette perforator of the present disclosure as it may typically be held while in use.

Referring now to FIG. 1*a*, there is a pictorial drawing of an embodiment of the cigarette perforator of the present disclosure as it may be held in the hand of a user with the thumb and index finger of the user each in a position to exert pressure upon a first or second spring-loaded reciprocating pin positioned within respective bores in the body of the cigarette perforating apparatus according to the present disclosure device in linearly opposing relationship along an acting diameter of the body portion of the device.

The cigarette perforator 10 of the present disclosure includes a torus shaped portion 12 having a central aperture 13 and a handle shaped portion 28. Passing through each side of the torus shaped portion 12 along a common diameter of the torus shaped portion 12 are a first bore 14 and a second bore 16. Included within the first bore 14 is a first spring-loaded reciprocating pin 18 and within the second bore 16 is a second spring-loaded reciprocating pin 20. The cigarette perforator 10 is shown as it may be held by a person's hand 22 with the person's thumb 24 positioned against the distal end of second pin 20 and the person's index finger 26 positioned against the distal end of first pin 18. The thumb 24 and index finger 26 are shown exerting pressure against the respective distal end of the pins 18 and 20 and causing the pins 18 and 20 to move inward along the common diameter so that pointed ends of the respective pins move inward toward each other and away from their retracted position within the torus shaped portion 12 of the cigarette perforator. By way of a feature to be described hereinbelow the first and second pins 18, 20, when depressed inward together, are inhibited from touching at their pointed ends. Further, the use of the thumb and the index finger is an illustrative example and is not intended to be limiting. Some users may find it more comfortable to use other ways of holding the cigarette perforator 10 and/or to use other fingers to depress the reciprocating pins than is shown in FIG. 1*a*.

In operation, the cigarette perforator 10 may be illustratively supported by grasping a handle portion 28 between the palm 30 and the middle finger 32 of the person's hand 22 as shown in FIG. 1*a*. When it is desired to perforate a cigarette, the thumb 24 and index finger 26 are relaxed to a position that permits the pins 18 and 20 to be retracted within the torus shaped portion 12 and allowing a cigarette 34 to be inserted into the central aperture 13 of the cigarette perforator 10 substantially along a path indicated by a dashed line 35. Thereupon, the thumb 24 and index finger 26 may be moved toward each other to exert pressure upon the distal ends of the pins 18 and 20 and cause the respective pins to move inward toward each other along the common diameter and perforate the outer covering of cigarette 34 while it is positioned within the aperture 13.

Figure 1B:
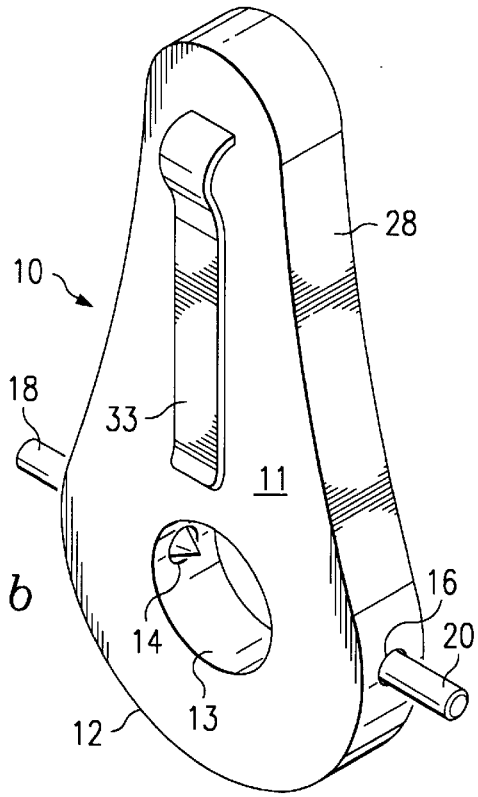
FIG. 1*b* illustrates an alternate embodiment of the cigarette perforator of the present disclosure having a clip for securing it to a pocket.

Referring now to FIG. 1*b* there is shown an alternate embodiment of the cigarette perforator 10 of the present disclosure. The cigarette perforator 10 of the present disclosure includes the torus shaped portion 12 having the central aperture 13 and the handle shaped portion 28. Passing through each side of the torus shaped portion 12 along a common diameter of the torus shaped portion 12 are a first bore 14 and a second bore 16. Included within the first bore 14 is a first spring-loaded reciprocating pin 18 and within the second bore 16 is a second spring-loaded reciprocating pin 20. The first and second pins 18, 20 are shown in a retracted position. A clip 33 is attached at one end to the distal end of the handle shaped portion 28. The clip 33, which may be spring loaded to bias the clip in a closed position against the handle portion 28 of the cigarette perforator 10, enables the cigarette perforator 10 to be clipped to a pocket in the manner of a writing instrument or, illustratively, to the front panel of an opened cigarette box for containing cigarettes (not shown). The clip 33 may be configured variously to allow clipping the cigarette perforator 10 to different shapes or thicknesses of material.

Figure 2:
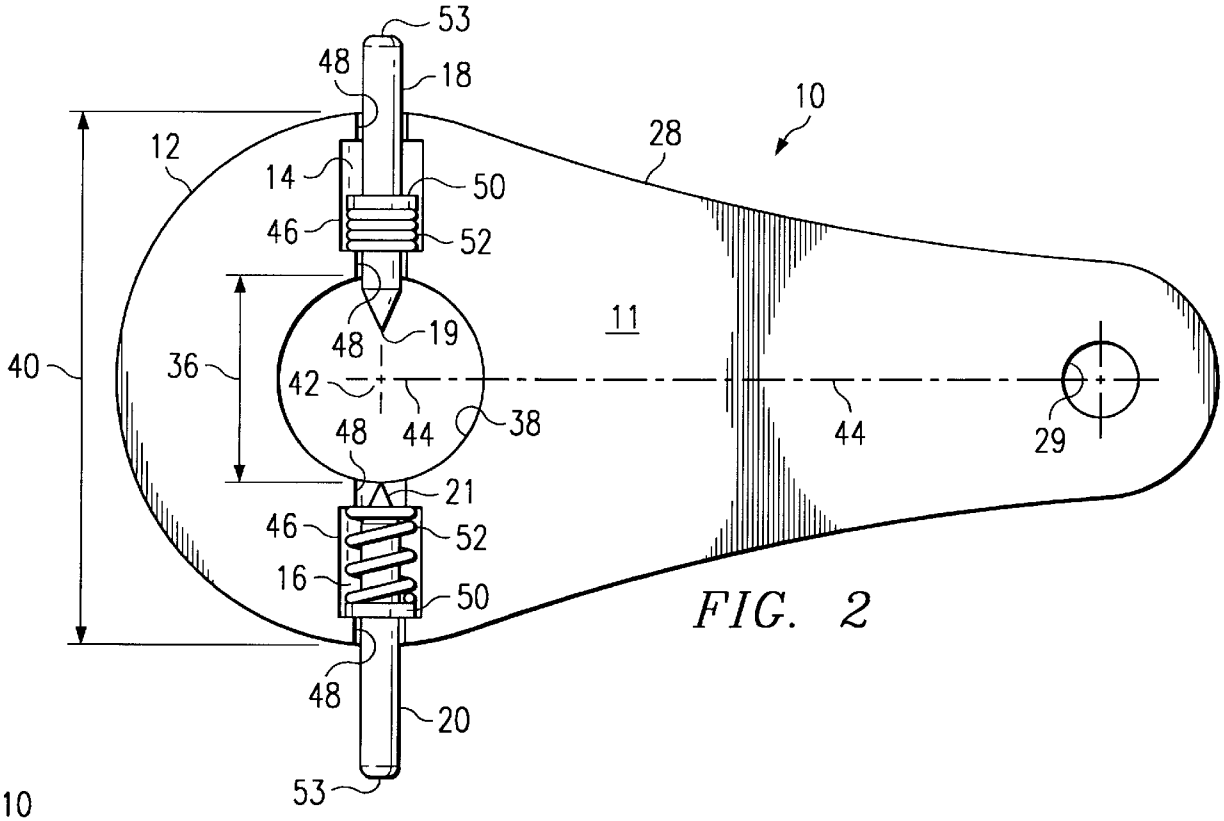
FIG. 2 illustrates a plan view of the embodiment of the present disclosure illustrated in FIG. 1.

Referring now to FIG. 2, there is illustrated a plan view of a section taken midway through the thickness of the body 11 of the cigarette perforator 10 of the present disclosure. The body 11 of the cigarette perforator 10, as described hereinabove comprises a torus shaped portion 12 and a handle shaped portion 28. A hole 29, passing through the handle shaped portion 28, may be provided to permit carrying the cigarette perforator 10 on a key chain or lanyard (not shown), a key ring (not shown) or the like. The sectional view of the body 11 in FIG. 2 illustrates the shape of the first bore 14 and the second bore 16 and the shape and the relative position within the respective bores 14 and 16 of the first and second spring-loaded reciprocating pins 18 and 20. The first reciprocating pin 18 has a pointed end 19 at its inward end and the second spring-loaded reciprocating pin 20 has a pointed end 21 at its respective inward pointing end.

Continuing with FIG. 2, other features of the torus shaped portion 12 of the body 11 include an inside diameter 36 of a central aperture 38 and an outside diameter 40 which represents the outer diameter of the torus shaped portion 12 of the body 11 of the cigarette perforator 10. It will be observed that the central aperture 38 is centered at the intersection of a common diameter 42 shown passing through the central aperture 38 and of a radius line 44 which passed through the central aperture 38 approximately perpendicular to the common diameter 42 and thus extends away from the common diameter 42. The radius line 44 represents the axis of the handle portion 28 of the body 11 of the cigarette perforator 10 which extends away from the torus shaped portion 12 of the body 11 providing a handle with which more to readily grasp the cigarette perforator 10 of the present disclosure. The angle between the common diameter 42 and the radius line 44 may be adjusted to more closely match the average or typical shape of a user's hand for a more comfortable grip and operation.

Continuing with FIG. 2, there is also shown the respective first and second bores 14 and 16 which contain respectively the first and second pins 18 and 20. Each first and second bore 14 and 16 includes a first bore diameter 46 substantially along the length of the bore 14, 16 except at each end of the bore 14, 16 which includes a second bore diameter 48 which is a smaller diameter bore than first bore diameter 46. It will appreciated that the second, smaller diameter bore 48 is slightly larger than the diameter of the respective first or second pin 18, 20 as shown in FIG. 2 to allow free movement of the respective pin 18, 20 within its bore 14, 16.

A further feature of each pin 18, 20 is a shoulder portion 50 on each pin 18, 20 that is disposed perpendicular to the axis of the respective pin 18, 20 and is positioned approximately midway along the length of the respective pin 18, 20. The diameter of the shoulder portion of the respective pin 18, 20 is shown slightly smaller than the first bore diameter 46, permitting the pin to move longitudinally along its axis within its respective first bore 14 or second bore 16. The shoulder portion 50, besides movably positioning the respective pin within its respective bore in the manner of a piston within a cylinder also retains the pin within the respective bore 14, 16 by limiting its longitudinal travel between the second smaller diameter bore 48 at the outward end of the respective bore and the opposite extremity of the first bore 14 which includes the compressed height of the helical spring 52 as shown in the pin/bore combination 18/14 of the upper portion of FIG. 2.

Continuing further with FIG. 2, as shown in the lower pin/bore combination 20/16 of FIG. 2, the pin 20 is shown in a retracted position under the influence of an expanded helical spring 52 within the bore 16. Similarly, in the upper portion of FIG. 2 is shown the inwardly displaced position of the pin 18 as it may exist when external pressure is exerted inward upon the distal end 53 of the pin 18 thus compressing the helical spring 52 and permitting the pin 18 to move to its inwardly extended position enabling the pointed end 19 of pin 18 to enter the central aperture 38 and pierce the outer covering of a cigarette that has been inserted through the central aperture 38. It will be appreciated that each pin 18, 20 may be individually pressed against the tension of its respective helical spring 52 in order to cause an individual pin 18 or 20 to enter the central aperture 38 or, alternatively, both pins 18 and 20 may be caused to move together toward each other causing both pointed ends 19 and 21 of the respective first pin 18 and second pin 20 to enter the central aperture 38 and pierce the outer covering of a cigarette placed therein on opposite sides of the cigarette.

It will be appreciated that the simple structure described hereinabove provides the ability to perforate the outer covering of a cigarette at any desired position or any number of times in order to obtain the desired reduction in the toxicity of the smoke produced by the cigarette. Moreover it will be appreciated from the description provided hereinabove with respect to FIG. 2 that the cigarette perforator 10 of the present disclosure is of extremely simple construction and operation and is readily manufacturable by a variety of processes at a very low cost. For example, it will be observed that the cigarette perforator 10 illustrated in FIG. 2 is comprised of only three distinct parts—the body 11, a pin 18, 20 and a helical spring 52 for each pin 18, 20.

Figure 3:
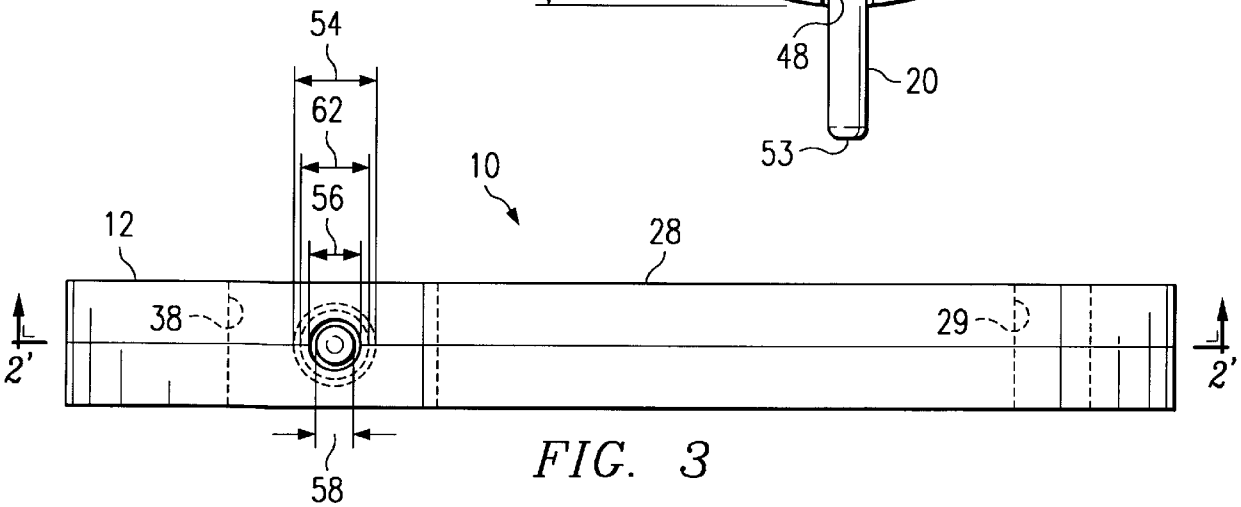
FIG. 3 illustrates a side view of the cigarette perforator illustrated in FIG. 2.

Many processes for manufacturing the cigarette perforator 10 of the present disclosure are possible and indeed feasible. In one illustrative example, the body 11, including the bore portions 14 and 16, may be injection molded of a plastic material in identical halves along a parting line 2'—2' as shown in FIG. 3 and parallel to the larger flat surfaces of the body 11 of the cigarette perforator 10. Since all of the dimensions are symmetrical about the parting line 2'—2' and the line 44, the two halves for the body 11 will be identical except for, illustratively, the device or feature (not shown) with which the two halves may be assembled and latched together. Such device or feature for latching or securing two halves of the body 11 together does not form part of the present disclosure because many variations are possible as will be apparent to persons skilled in the art. The pins 18 and 20 may likewise be molded of plastic or other material and placed in each bore section of one of the body halves, with a helical spring 52 slipped over each pointed end before the two halves of the body 11 are assembled. Persons skilled in the art will further recognize numerous other ways of manufacturing the cigarette perforator 10, some having hollow body part(s) as in the illustrative example and others having a solid body, machined bore inserts and/or reciprocating pins, etc. Further, various types of springs may be utilized without departing from the principles of the present disclosure.

Referring now to FIG. 3, there is illustrated a side view of the embodiment of the cigarette perforator 10 illustrated in FIG. 2 showing the approximate thickness proportion of the body 11 of the cigarette perforator 10 of the present disclosure and further showing the approximate position within the side of the torus shaped portion 12 through which the first and second bores 14, 16 and the first and second spring-loaded reciprocating pins 18, 20 are positioned within the body 11 of the cigarette perforator 10. Also shown in FIG. 3 are the relative proportions of the first bore diameter 54 and the second bore diameter 56 as well as the pin diameter 58 and the diameter 62 of the shoulder portion of each pin 18, 20.

Figure 4:
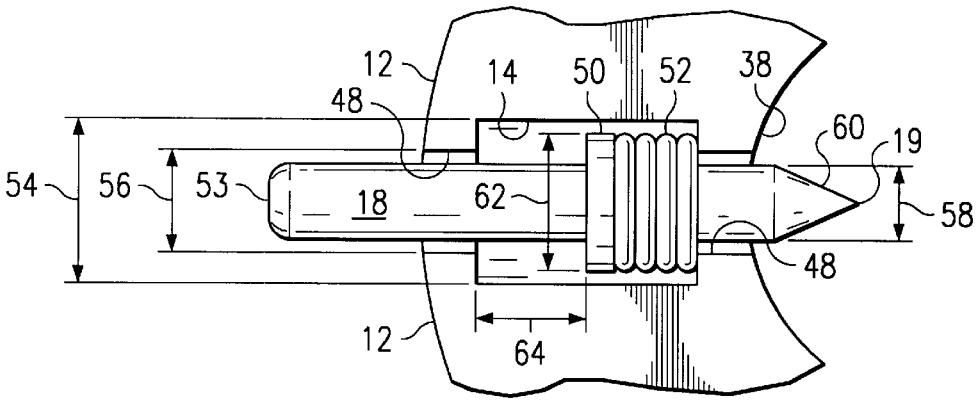
FIG. 4 illustrates an enlarged view of a portion of the cigarette perforator of the present disclosure shown in FIG. 2.

Referring now to FIG. 4, there is illustrated an enlarged view of the first spring-loaded reciprocating pin 18 as shown in FIG. 2, which is enlarged to illustrate more clearly the relationships of the bore diameters and the pin diameters. All of the reference numbers of FIG. 4 are the same as the corresponding portions of the cigarette perforator 10 that are shown in FIGS. 2 and 3 and serve the same functions described therefor. The first spring-loaded reciprocating pin 18 is shown in the compressed position wherein the pointed end of pin 18 is shown extending into the central aperture 38 in a position to pierce the outer covering of a cigarette which is inserted into the central aperture 38. In this position of the first pin 18, the helical spring 52 is shown compressed between the inward end of the bore 14 and the shoulder portion 50 of the first pin 18. If the pressure upon the first pin 18 were relaxed from the distal end 53 of the first pin 18, then the first pin 18 would retract in a leftward direction in the orientation shown in FIG. 4 under the tension stored in helical spring 52 until the shoulder portion 50 contacted the leftward end of the first bore 14. The dimension 64 indicates the length of the stroke of reciprocating pin 18. The pin 18 is also shown in FIG. 4 having a tapered portion 60 for reducing the pin diameter 58 to a pointed end 19. The particular taper characteristic of the tapered portion 60 may preferably be a straight profile as shown or it may alternately have a curved profile or a profile having compound characteristics.

Figure 5:
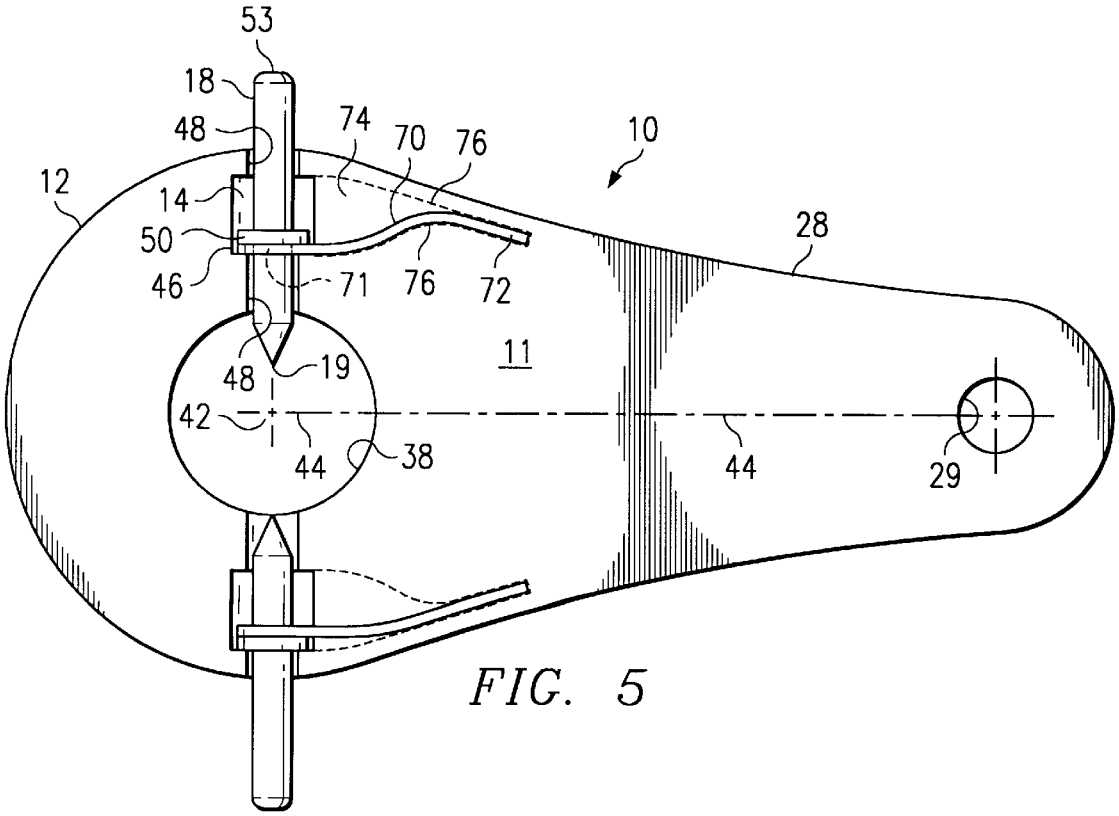
FIG. 5 illustrates an alternate embodiment of the cigarette perforator of the present disclosure.

Referring now to FIG. 5, there is illustrated an alternate embodiment of a cigarette perforator 10 of the present disclosure. The portion of a cigarette perforator shown in FIG. 5 illustrates one modification to the first bore 14 and the spring used to provide the restoring force for retracting the first pin 18 within the torus shaped portion 12 of the body 11 of the cigarette perforator 10. Instead of a helical spring 52 as shown in FIG. 2 hereinabove, there is shown a flat, longitudinal spring 70, shown in an edge-wise perspective. The first bore 14 is shortened because the flat spring 70 occupies very little of the length of the first bore 14. Compare FIG. 5 with the corresponding upper portion of FIG. 2 to see the similarities and the differences. Components and features of FIG. 5 having the same reference numbers as in FIG. 2 are structurally and functionally the same as the corresponding components and features of FIG. 2.

Continuing with FIG. 5, the pointed end 19 of first pin 18 passes through an opening 71 (not shown directly) in the left-most end of the flat spring 70. This opening 71 may illustratively be a round hole or a slot cut into the end of the flat spring 70. The flat spring 70 supports and provides spring loading for the first pin 18 in cantilever fashion within the body 11 of the cigarette perforator 10. The right most end of the flat spring 70 is retained within the narrow end 72 of a recess 74. A suggested boundary for the recess 74 is indicated by the dotted line 76. The recess 74 is shaped to allow movement of the flat spring 70 as the first pin 18 is depressed against the tension of flat spring 70 to cause insertion of the pointed end 19 into the aperture 38 (as described hereinabove for the embodiment illustrated in FIG. 2) and as the printed end 19 of the first pin 18 is allowed to retract back into the first bore 14. The second bore 16 and the second pin 20 as identified in FIG. 2 may be constructed in the same manner as shown in FIG. 5.

It will be apparent to persons skilled in the art that a number of variations of construction or other features are possible to achieve the functionality provided by the cigarette perforator 10 of the present disclosure. For example, the body 11 may be formed of a variety of materials and by a variety of processes and if constructed of two essentially symmetrical halves may be assembled by a variety of methods or devices. The body 11 may further be equipped with features to facilitate carrying the cigarette perforator 10, such as a hole for a key chain or lanyard or a clip for securing the device to a pocket or the edge of a flat member. Further, the reciprocating pins 18, 20 may be fabricated of a variety of materials including various metals or even plastic materials that are engineered to provide the durability that would be required. For example, the hardness requirements for the material used to make the pins 18, 20 would not be particularly stringent since the anticipated material of which the outer covering of a cigarette is made is typically soft and thin. Thus, a particularly hard substance for the fabrication of the reciprocating pins is not required. The helical springs 52 as shown in FIG. 2 may be of conventional construction of tempered spring wire or may be fabricated in other ways as will be apparent to those skilled in the art. Further, as illustrated in FIG. 5, other types of spring may be adapted to provide similar functionality.

Although the preferred embodiment has been described in detail, it should be understood that various changes, substitutions and alterations can be made therein without departing from the spirit and scope of the invention as defined by the appended claims.

What is claimed is:

1. Apparatus for perforating a cigarette, comprising:

a body having a torus shaped portion, said torus shaped portion having an inside diameter forming an aperture and an outside diameter, and a handle portion contiguous with said torus shaped portion and extending along a radius of said torus shaped portion beyond said outside diameter, wherein said aperture is sized to allow passage of said cigarette therethrough;

first and second bores disposed through opposite sides of said torus shaped portion along an acting diameter of said torus shaped portion and oriented approximately perpendicular to said radius; and first and second spring-loaded, reciprocating pins formed to a point at each inward-directed end and set in linearly opposing relationship along said acting diameter of said torus shaped portion respectively in said first and second bores, wherein each one of said first and second pins is biased to a retracted position under spring loading within a respective one of said first and second bores such that said pointed end of each said pin is disposed in said retracted position within said respective bore of said torus shaped portion and an outward end of each said pin extends outward from said first and second respective bores beyond said outside diameter of said torus shaped portion by a first predetermined distance.

2. The apparatus of claim 1, wherein said first and second pins are operable to move inward within said first and second respective bores from said retracted position and enter said aperture upon applying radially inward pressure upon said first or second pin against said spring loading and along the longitudinal axis of each said first or second bore such that said respective pointed end of said first or second pin is caused to move longitudinally inward toward each other into said aperture by a second predetermined distance and pierce the outer covering of a cigarette inserted into said aperture.

3. The apparatus of claim 2, wherein said second predetermined distance limits the movement of each said respective first or second pin such that said pointed ends of said pins do not touch when both said first and second pins are in a fully inward position.

4. The apparatus of claim 1, wherein said body of said apparatus is sized to be held within a person's hand and configured to permit exerting pressure upon said outward ends of said first and second pins with said person's index finger and thumb respectively of said hand.

5. The apparatus of claim 1, wherein each one of said first and second bores comprises a first bore diameter substantially along its length except at each end of said length where said bore has a second, smaller diameter.

6. The apparatus of claim 5, wherein said second, smaller diameter of said bore provides for limiting movement of each said pin within its respective bore.

7. The apparatus of claim 5, wherein said first and second pins comprise a length approximately equal to one-half said outside diameter of said torus shaped portion, a pin diameter slightly less than said second smaller diameter of said bore and a circular shoulder portion, of diameter slightly less than said first bore diameter, fixed to a middle portion of said pin.

8. The apparatus of claim 7, comprising:

a helical spring disposed over said pointed end of each said pin between an inward end of said respective bore and an inward side of said shoulder portion of said respective pin.

9. The apparatus of claim 8, wherein said helical spring provides said spring loading for retracting said first or second pin within said respective first or second bore to said retracted position.

10. The apparatus of claim 1, wherein said spring loading is provided by a helical spring axially disposed over said pointed end of each said pin between a partially closed inward end of said respective bore and a shoulder portion of said respective pin, said shoulder portion fixed to a middle portion of said respective pin.

11. The apparatus of claim 1, wherein said spring loading is provided by a flat, longitudinal spring supporting said respective pin at a first end within said respective bore, said spring fixed at an opposite end thereof within said body of said apparatus such that said respective pin is supported in cantilever fashion.

12. The apparatus of claim 1, wherein said body of said apparatus further comprises:

a hole through said handle portion for passage of a chain, ring or lanyard therethrough for carrying said apparatus.

13. The apparatus of claim 1, wherein said body of said apparatus further comprises:

a spring clip attached to said handle portion for securing said apparatus to the edge of a pocket or other thin member.

* * * * *